US009720436B2

(12) United States Patent
Hisatsugu

(10) Patent No.: US 9,720,436 B2
(45) Date of Patent: Aug. 1, 2017

(54) OPERATION INPUT DEVICE

(71) Applicant: DENSO CORPORATION, Kariya, Aichi-pref. (JP)

(72) Inventor: Shinsuke Hisatsugu, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/038,140

(22) PCT Filed: Oct. 30, 2014

(86) PCT No.: PCT/JP2014/005502
§ 371 (c)(1),
(2) Date: May 20, 2016

(87) PCT Pub. No.: WO2015/075873
PCT Pub. Date: May 28, 2015

(65) Prior Publication Data

US 2016/0291632 A1 Oct. 6, 2016

(30) Foreign Application Priority Data

Nov. 22, 2013 (JP) ..... 2013-242015

(51) Int. Cl.
*G05G 9/047* (2006.01)
*G05G 5/03* (2008.04)
*H01H 25/04* (2006.01)

(52) U.S. Cl.
CPC ..... *G05G 9/047* (2013.01); *G05G 5/03* (2013.01); *H01H 25/041* (2013.01);
(Continued)

(58) Field of Classification Search
CPC ..... G05G 9/047; G05G 2009/04766; G05G 2009/04722; G05G 5/03; G05G 5/05; H01H 25/041; H01H 2025/043
See application file for complete search history.

(56) References Cited

U.S. PATENT DOCUMENTS 6,399,904 B1 * 6/2002 Mimata ..... G05G 9/047 200/406
2001/0011630 A1 * 8/2001 Loschner ..... G05G 9/047 200/6 A (Continued)

FOREIGN PATENT DOCUMENTS

JP 2000047811 A 2/2000
JP 2000285767 A 10/2000

(Continued)

*Primary Examiner* — David M. Fenstermacher
*Assistant Examiner* — Jake Cook
(74) *Attorney, Agent, or Firm* — Harness, Dickey & Pierce, P.L.C.

(57) ABSTRACT

In an operation input device, a supporting part supports an operation part to be displaceable with respect to the base part, and a reaction force generating part generates reaction force in an axial direction coaxial with the displacement direction in response to the displacement. The supporting part includes: a support member having: one end connected to the base part and another end protruded from the base part; and a plurality of plate springs respectively having a plate surface perpendicular to a center axis of the support member, arranged radially around the center axis, and a tip in a radial direction connected to the operation part. The reaction force generating part includes: an electromagnet generating magnetic force in an axial direction parallel to the center axis of the support member; and a magnetic member arranged opposite to the electromagnet to receive magnetic force to apply reaction force to the operation part.

2 Claims, 3 Drawing Sheets

(52) U.S. Cl.
CPC ..... *G05G 2009/04722* (2013.01); *G05G 2009/04766* (2013.01); *H01H 2025/043* (2013.01)

(56) References Cited

U.S. PATENT DOCUMENTS

| | | | | |
|---|---|---|---|---|
| 2002/0054015 | A1 | 5/2002 | Wingett et al. | |
| 2002/0097224 | A1* | 7/2002 | Nishino ..... | G05G 9/047 345/161 |
| 2002/0122025 | A1 | 9/2002 | Suzuki et al. | |
| 2004/0080491 | A1 | 4/2004 | Takatsuka et al. | |
| 2007/0211021 | A1* | 9/2007 | Kang ..... | G01D 5/145 345/156 |
| 2010/0170349 | A1 | 7/2010 | Hatanaka et al. | |
| 2011/0140818 | A1 | 6/2011 | Hatanaka et al. | |

FOREIGN PATENT DOCUMENTS

| | | | |
|---|---|---|---|
| JP | 2002175154 | A | 6/2002 |
| JP | 2004327232 | A | 11/2004 |
| JP | 2006059649 | A | 3/2006 |
| JP | 2009301871 | A | 12/2009 |
| JP | 2010170576 | A | 8/2010 |
| JP | 2010181398 | A | 8/2010 |
| JP | 2011123739 | A | 6/2011 |
| JP | 2012064514 | A | 3/2012 |

* cited by examiner

OPERATION INPUT DEVICE

CROSS REFERENCE TO RELATED APPLICATIONS

This application is a U.S. National Phase Application under 35 U.S.C. 371 of International Application No. PCT/JP2014/005502 filed on Oct. 30, 2014 and published in Japanese as WO 2015/075873 A1 on May 28, 2015. This application is based on and claims the benefit of priority from Japanese Patent Application No. 2013-242015 filed on Nov. 22, 2013. The entire disclosures of all of the above applications are incorporated herein by reference.

TECHNICAL FIELD

The present disclosure relates to an operation input device that includes an operation part supported by a supporting part in a displaceable manner, and that gives an operational feeling to a user by generating a reaction force to an operation when the operation part is operated.

BACKGROUND ART

It has been well-known that an operation input device is configured so that, when an operation part is supported by a supporting part which is elastically deformable, the supporting part is deformed to make an operation part to be displaced in an operation direction as the operation part is operated (for example, see Patent Literatures 1 and 2).

This type of operation input device is used as an operation input device such as a joystick and a touch pad, and detects the operation direction/operation amount of the operation part used by a user and inputs a detection result as an operation command value to a variety of information processing devices when the displacement of the operation part is detected by a switch or a sensor.

In addition, it has been well-known that this type of operation input device provides a reaction force generating part (i.e., a restoring force generating part) that adds a reaction force to the operation for the operation part at the time of operation so that a user has a feeling of operation when operating the operation part (for example, see Patent Literature 3).

PRIOR ART LITERATURES

Patent Literature

Patent Literature 1: JP-2000-285767-A
Patent Literature 2: JP-2010-170576-A
Patent Literature 3: JP-2011-123739-A

SUMMARY OF INVENTION

For any one of the conventional operation input devices, the supporting part is configured by an elastic member and a damper member including, for example, a resin component and rubber or elastomer; and the operation part is displaced in an arbitrary direction in response to the operation made by a user. Accordingly, when the user touches the operation part, the operation part easily moves in a direction different from the operation input direction and thus worsen the operability. In a case of having a reaction force generating part, the reaction force attenuates on one portion of rubber or elastomer.

With regard to the above situation, as described in Patent Literature 3, the operation input device having the reaction force generating part prevents a careless movement of the operation part through a reaction force generated by the reaction force generating part.

However, with regard to the operation input device described in Patent Literature 3, in order to prevent the reaction force generating part causing inconvenience to the operation of the operation part, an electromagnet is used as the reaction force generating part to as to provide a reaction force on the operation part without making contact.

However, with regard to the operation input device, the reaction force generating part may prevent the inconvenience to the operation of the operation part; however, when the operation part is operated in a direction different from the reaction force added to the operation part from the reaction force generating part, the reaction force cannot be generated in a direction for restricting the displacement of the operation part so that the user feels the shake of the operation part.

It is an object of the present disclosure to provide an operation input device that can apply a reaction force to the operation part without making contact; and that arbitrarily adjusts the easiness of the deformation to the specific input operation direction and restricts the displacement of the operation part in a direction different from the reaction force direction to prevent from lowering the operability of the operation part at the time of operating the operation part.

The operation input device according to an aspect of the present disclosure includes an operation part, a supporting part and a reaction force generating part. The support part supports the operation part to be displaceable. The support part includes: a support member having one end connected to the base part and another end protruded from the base part; and a plurality of plate springs arranged at the other end of the support member.

The plurality of plate springs are arranged such that the plate surface is perpendicular to the center axis of the support member in the protruding direction and the plurality of plate springs are protruded radially around the center axis of the support member. And the tip in the radial direction is connected to the operation part.

The reaction force generating part generates a reaction force in a direction (i.e., Z-axis) that is perpendicular to an operation input direction (i.e., X-axis, Y-axis, and θ) in response to the direction of the operation part. The reaction force generating part includes: an electromagnet that is arranged at one of the base part and the operation part to generate a magnetic force in an axial direction parallel to the center axis of the support member in the protruding direction; and a magnetic member that is arranged at a position opposite to the electromagnet at the one of the operation part and the base part to receive the magnetic force generated by the electromagnet to apply a reaction force to the operation part.

Accordingly, when the user operates the operation part, the plurality of plate springs for configuring the supporting part are respectively easy to deform (i.e., easy to bend) in a direction identical to the direction of the magnetic force (or pulling force or reaction force) generated by the electromagnet of the reaction force generating part. In addition, the plurality of plate springs have higher spring constant as the torsion, suspension, and compression are applied in the plate thickness direction with respect to the other directions, and the cross sectional second moment gets larger and the rigidity occurs and hence the deformation is hardly to occur.

According to the operation input device according to the present disclosure, with the shape combination of the plate spring and the support member, the easiness of the deformation to the specific input operation direction at the time of operating the operation part in X-axis, Y-direction, and θ directions can be arbitrarily adjusted so as to restrict the displacement of the operation part in a direction different from the direction of generating a reaction force in the Z-axis without lowering the transmission efficiency of the reaction force generated by the reaction force generating part so that the user does not have shaky feeling on operating the operation part. According to the operation input device of the present disclosure, the operability of the operation part is ensured.

The reaction force generating part transmits the reaction force from the base part side to the operation part side without making contact through the magnetic force between the electromagnet and the magnetic member. Accordingly, it is prevented that the energy loss caused by, for example, friction and viscosity occurs at the reaction force transmission path between the operation part and the base part. Thus, the operability of the operation part is also improved.

The load applied to the operation part from outside is not transmitted to the base part side directly through the reaction force generating part; therefore, it is prevented that the function of the reaction force generating part is lowered by the load so as to damage the reaction force generating part.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

The following describes an embodiment of the present disclosure with reference to the drawings.

It is noted that while the present disclosure is described with reference to the following embodiment, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

An operation input device 2 of the present embodiment is arranged, for example, near the driving seat of a vehicle, and receives an input of a variety of commands to an information processing device such as a navigation device mounted to a vehicle through the operation made by a user.

Figure 1:
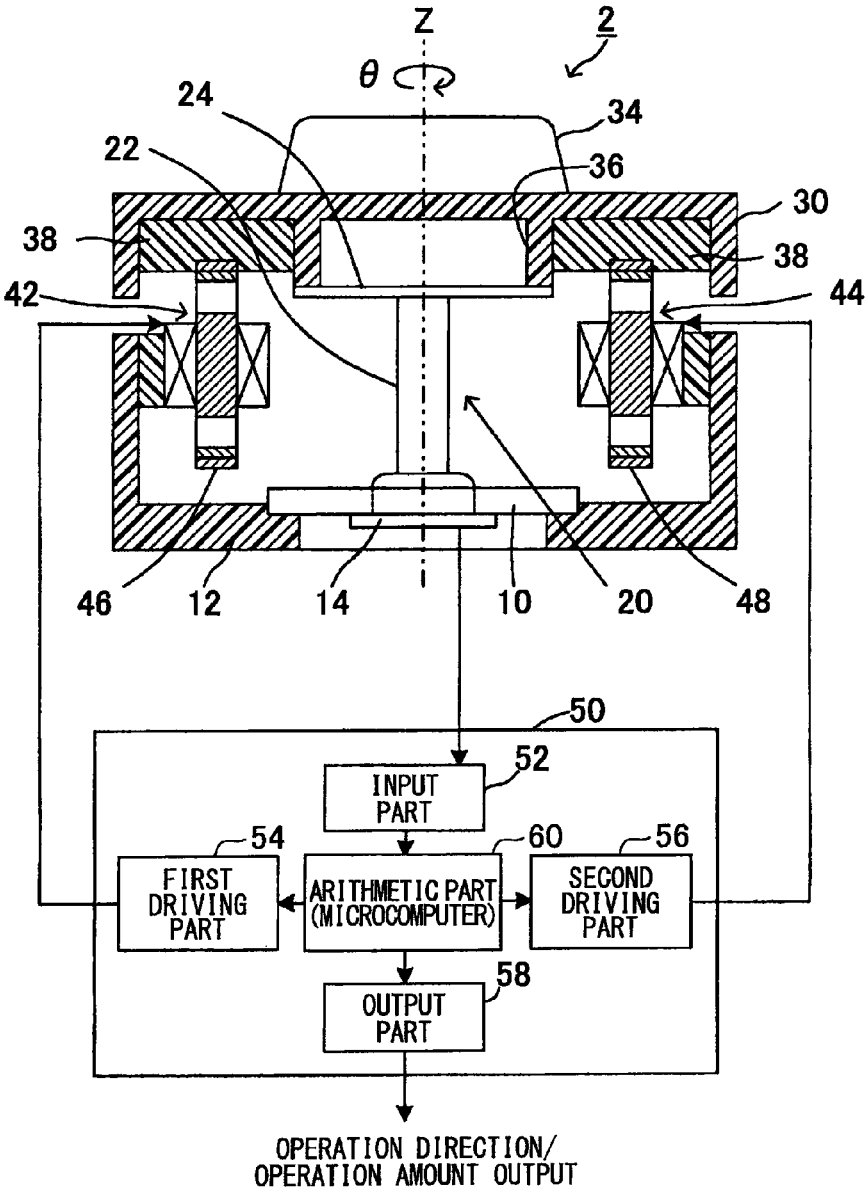
FIG. 1 is a drawing that illustrates the configuration of a whole operation input device according to an embodiment.

As shown in FIG. 1, the operation input device 2 includes: a base part 10 fixed to a vehicle body side; and an operation part 30 that is arranged to be in a displaceable manner with respect to the base part 10 through a supporting part 20.

The base part 10 is fixed inside a rectangular casing 12 with having one opening end, and is fixed to a predetermined location inside the vehicle cabin through the casing 12. It is noted that the casing 12 is made of non-conductive composite resin.

The base part 10, which is arranged into a plate form, is fixed to the bottom part of the casing 12. A rod-shaped support member 22 for configuring a supporting part 20 has one end connected to a central portion of the plate surface of the base part 10 through a detecting element 14 for detecting the operation direction and the operation amount of the operation part 30; and has another end protruded to the opening of the casing 12.

The operation part 30 has the opening which has a shape substantially identical to the opening of the casing 12, and is a cover body having a synthetic resin property for closing the opening of the casing 12 by making both openings overlap each other. An operation protruding part 34 for allowing the user to put his or her hand on the operation protruding part 34 to operate the operation part 30 is arranged at the top of the operation part 30 (in particular, at a side opposite side of the opposite surface of the casing 12).

Figure 2:
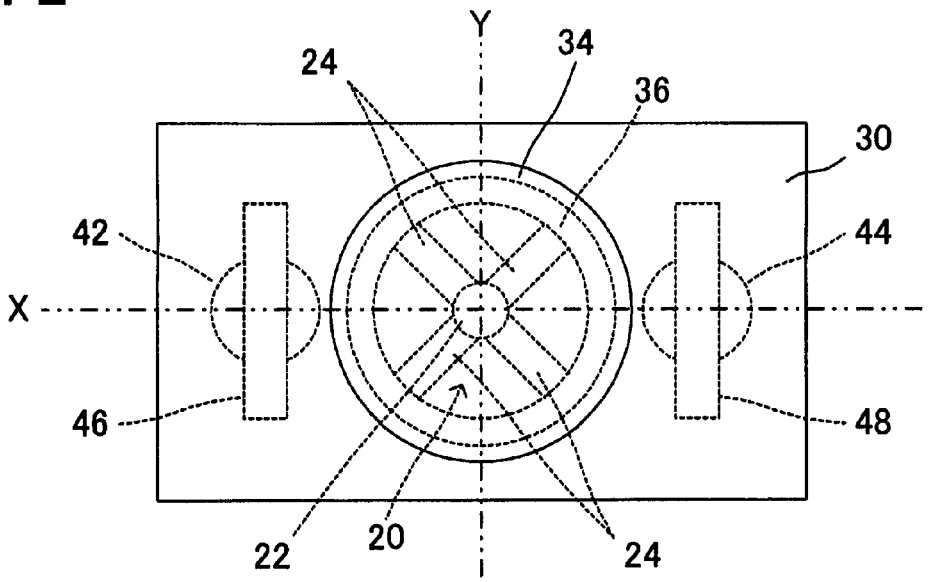
FIG. 2 is a plan view that illustrates a state of an operation part of the operation input device viewed from an operation direction (i.e., top)

The operation protruding part 34 allows the user to rotate the operation part 30 around the center axis Z in a protruding direction from the base part 10 of the support member 22 (in other words, a longitudinal direction of the support member 22), and to move the operation part 30 along an X-Y plane (see FIG. 2) perpendicular to the center axis Z.

The detecting element 14 is configured by a strain gauge that detects a force in an X-axis direction and a Y-axis direction added from the operation part 30 through the support member 22 and a force around the Z-axis.

According to the operation input device 2 of the present embodiment, the operation amount of the operation part 30 to the X-axis and Y-axis directions through the detecting element 14 and the rotation operating amount θ around the Z-axis can be detected.

Next, the support member 20 includes: the above-mentioned rod-shaped support member 22; and four plate springs 24 arranged radially with a substantially 90 degree interval around the center axis Z of the support member 22 at the end part of the of the support member 22 at a side opposite to the base part 10.

The support part 20 supports the operation part 30 in a displaceable manner in a direction of the center axis Z of the support member 22 by means of fixing the tip ends of the spring plates 24 in a radial direction to a cylindrical connecting protrusion 36 arranged to protrude to the surface side of the operation part 30 opposite to the base part 10.

In other words, the plate spring 24 is arranged such that the plate surface is perpendicular to the center axis Z of the support member 22. For instance, when the user presses the operation part 30 with his or her hand, the force in an axial direction parallel to the center axis Z of the support member 22 is applied to the plate spring 24 from the connecting protrusion 36 so that the operation part 30 approaches to the base part 10 by bending the plate spring 24.

In addition, when the user moves away his or her hand from the operation part 30, the plate spring 24 returns to the original reference position through the reaction force of the plate spring 24 and then the operation part 30 is away from the base part 10.

Figure 3:
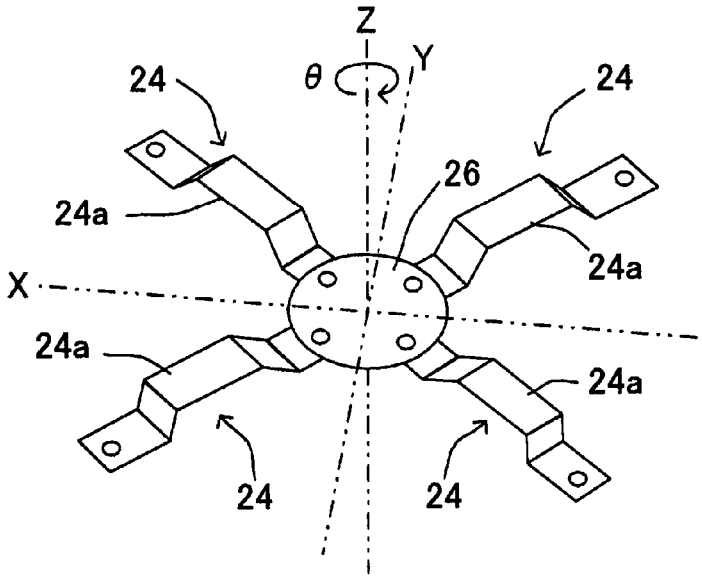
FIG. 3 is a perspective view that illustrates a flat spring of the operation input device.

As shown in FIG. 3, the four plate springs 24 are respectively arranged to be extended outwardly from a fixing part 26 fixed at the end part of the support member 22. Then, with regard to each of the four plate springs 24, at the center in a radial direction from the fixing part 26 to the tip part, a stepped part 24*a* is arranged by bending along a line intersecting the center axis of the radial direction.

In a state where the four plate springs 24 are fixed to the support member 22 through the fixing part 26; and the tip part of each of the four plate springs 24 are fixed to the connecting protrusion 36 of the operation part 30, the plate spring 24 is easy to bend when the operation part 30 displaces in a direction of the center axis Z of the support member 22 through an external operation.

The support member 22 attached by the plate spring 24 is configured by a structure body made of resin or metal material so as to deform with a predetermined amount in an input operation direction of the operation part 30.

With regard to the casing 12, electromagnets 42, 44 are arranged at a pair of side walls opposite to each other so as to pinch the supporting part 20 configured by the support member 22 and the plate spring 24.

The electromagnets 42, 44 are respectively attached to each of the side walls so as to make the center axis of the iron to be parallel with the center axis of the support member 22. At the surrounding of the electromagnets 42, 44, yokes 46, 48 formed in a ring shape made of a magnetic member such as iron are arranged to pinch the magnetic poles (i.e., both ends of an iron core) of the electromagnets 42, 44.

The yokes 46, 48, which are located at the surface side of the operation part 30 opposite to the base part 10, are fixed to the operation part 30 through a fixing member 38 arranged at the surrounding of the connecting protrusion 36.

At the position opposite to the magnetic poles of the electromagnets 42, 44 on the yokes 46, 48, a magnet is arranged to receive magnetic force generated by the electromagnets 42, 44 to generate a reaction force (in particular, pulling force or compulsion force) in a direction (i.e, Z) perpendicular to the operation direction (i.e, X, Y, θ) at the operation part 30.

Thus, a reaction force generating part is configured by the electromagnets 42, 44 and the yokes 46, 48. With regard to the configuration and the operation of such reaction force generating part, since they are described in detailed in JP-2011-0123739-A (US2011/0140818) listed as the Patent Literature 3, one part of the present specification cites the whole disclosure of JP-2011-0123739-A (US2011/0140818) so that the detail description of the reaction force generating part is omitted.

A circuit board (not shown) for configuring a control circuit 50 in FIG. 1 is stored inside the casing 12 to which the base part 10 is fixed.

The control circuit 50 includes: an input part for receiving a detection signal from the detecting element 14; a first driving part 54 and a second driving part 56 to make current flow into the winding wires of the electromagnets 42, 44 to generate magnetic force; and an arithmetic part 60 that computes the operation direction and the operation amount of the operation part 30 based on the detection signal from the input part 52.

The arithmetic part 60 is configured by a microcomputer mainly with, for example, a CPU, a ROM and a RAM, and outputs the operation direction and the operation amount of the operation part 30 as a computation result to an external device such as a navigation device from the output part 58 as an operation command value inputted by the user.

When the first driving part 54 and the second driving part 56 respectively control current flowing through the electromagnets 42, 44 in response to the operation direction and the operation amount of the operation part 30 as the computation result, the arithmetic part 40 is carried out to control a reaction force provided to the operation part 30 from the reaction force generating part configured by the electromagnets 42, 44 and the yokes 46, 48.

As described above, according to the operation input device 2 of the present embodiment, the supporting part 20 for supporting the operation part 30 in a displaceable manner with respect to the base part 10 includes: the support member 22 that protrudes to the base part 10; and the four plate springs 24 that are fixed to the tip part of the support member 22 in a protruding direction.

Each of the four plate springs 24 are arranged such that the plate surface is perpendicular to the center axis Z of the support member 22 and are protruded radially around the center axis of the support member 22, and the tip of each of the four plate springs 24 is fixed to the connecting protrusion 36 of the operation part 30.

Accordingly, the operation part 30 of the present embodiment is supported by only the four plate springs 24 for configuring the supporting part 20 so that each of the four plate springs 24 is easy to deform in a direction of the center axis of the support member 22 (in other words, each of the four plate springs 24 is easy to bend).

Accordingly, according to the operation input device 2 of the present embodiment, the reaction force, which is generated through an electrical conduction of the electromagnets 42, 44, to the operation part 30 is efficiently conducted.

Figure 4:
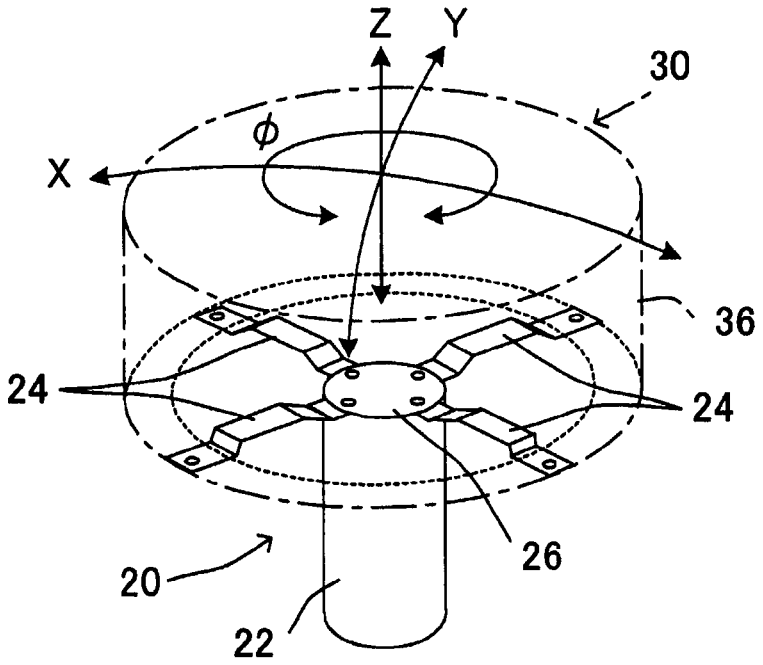
FIG. 4 is a drawing that illustrates the operation direction of the operation part and the supporting part in the operation input device including the flat spring.

On the other hands, when forces in other directions (such as forces in X-axis and Y-axis directions and force θ around Z-axis) are applied to the operation part 30 as shown in FIG. 4, each of the four plate springs 24 has a higher spring constant as the torsion, tension and compression are added in a plate thickness direction; and the cross-sectional second moment gets larger so that the each of the four plate springs 24 add rigidity and therefore gets harder to deform.

The operation input device 2 of the present embodiment, without lowering the transmission efficiency of the reaction force generated by the conduction of the electromagnets 42, 44, restricts that the operation part 30 displaces in a direction different from the direction of the reaction force generation to prevent the situation in which the user has a shaky feeling on operating the operation part 30.

According to the operation input device 2 of the present embodiment, the operability of the operation part can be ensured.

With regard to the present embodiment, the electromagnets 42, 44, for configuring the reaction force generating part, and the yokes 46, 48 transmit a reaction force without making contact, therefore, there is no energy loss caused by friction and viscosity through a reaction force transmitting path between the operation part 30 and the base part 10 so that the operability of the operation part 30 can be improved.

The load applied to the operation part 30 from outside is not directly transmitted to the base part 10 side through the reaction force generating part so that it is prevented that the function performed by the electromagnets 42, 44 and the yokes 46, 48 as the reaction force generating part gets lower through the load so as to damage each part of these components.

Modification Example

The above describes one embodiment in accordance with the present disclosure; however, the present disclosure is not only restricted to the above embodiment, a variety of embodiments within the scope of the present disclosure may be presented.

For example, the above embodiment describes that there are four plate springs 24 for configuring the supporting part 20. However, a plurality of plate springs 24, for example, two plate springs 24 may also be arranged. In addition, the above embodiment describes that the stepped part 24*a* is arranged at the plate spring 24; however, the stepped part 24*a* is not necessarily to be arranged at the plate spring 24.

In addition, the support member 22 may be protruded from the base part 10 so that the tip of the support member 22 can fix the plate spring 24. The rod-shaped support member 22 described in the above embodiment may not be necessarily used.

The above embodiment describes that the reaction force generating part is configured such that the electromagnets 42, 44 are arranged in the casing 12 at the base part 10 side and the yokes 46, 48 are arranged at the operation part 30 side so as to apply a reaction force without making contact from the base part 10 side to the operation part 30 side. However, the yoke may be provided at the base part 10 side and the electromagnet may be provided at the operation part 30 side.

A single magnet body may be used in replacement of the yoke, or an electromagnet may be used. In other words, other than the combination of the electromagnet and yoke described in the above embodiment, the combination of the electromagnet and magnet or the combination of the electromagnets may be configured as the reaction force generating part.

The above embodiment uses a strain gauge configured as a the detection element 14 for detecting the operation direction and the operation amount of the operation part 30; however, the support member 22 is fixed to be moveable with respect to the base part 10 so as to detect the moving position with the use of a sensor or a switch. In other words, for the detection element 14, a sensor or a switch for detecting the operation direction or the operation amount of the operation part 30 may also be used.

What is claimed is:

1. An operation input device comprising:

an operation part that is operated by a user;

a supporting part that supports the operation part to be displaceable with respect to a base part; and a reaction force generating part that generates a reaction force in a direction coaxial with a displacement direction of the operation part in response to a displacement of the operation part, wherein the supporting part includes:

a support member that has one end connected to the base part, and has an other end protruded from the base part; and a plurality of plate springs, located at the other end of the support member, that respectively have a plate surface perpendicular to a center axis of the support member in a protruding direction, and that are respectively arranged in a radial direction around the center axis in the protruding direction and have a tip end connected to the operation part, and wherein the reaction force generating part includes:

an electromagnet that is arranged at one of the base part and the operation part to generate a magnetic force in an axial direction parallel to the center axis of the support member; and a magnetic member that is arranged at a position opposite to the electromagnet at the one of the operation part and the base part, and that receives the magnetic force generated by the electromagnet so as to apply a reaction force to the operation part.

2. The operation input device according to claim 1, wherein each of the plurality of plate springs has a central portion from the support member to the tip end in the radial direction, and the central portion includes a stepped part.

* * * * *